US008317909B2

(12) United States Patent
Defalco

(10) Patent No.: US 8,317,909 B2
(45) Date of Patent: Nov. 27, 2012

(54) COMPOSITIONS AND PROCESSES FOR DEPOSITION OF METAL IONS ONTO SURFACES OF CONDUCTIVE SUBSTRATES

(75) Inventor: Frank G. Defalco, Houston, TX (US)

(73) Assignee: DFHS, LLC, Pelham, AL (US)

( * ) Notice: Subject to any disclaimer, the term of this patent is extended or adjusted under 35 U.S.C. 154(b) by 357 days.

(21) Appl. No.: 12/720,395

(22) Filed: Mar. 9, 2010

(65) Prior Publication Data

US 2010/0154673 A1 Jun. 24, 2010

Related U.S. Application Data

(63) Continuation-in-part of application No. 12/025,506, filed on Feb. 4, 2008, now abandoned.

(60) Provisional application No. 60/933,242, filed on Jun. 5, 2007.

(51) Int. Cl.

| | |
|---|---|
| ***C23C 18/31*** | (2006.01) |
| ***C23C 18/32*** | (2006.01) |
| ***C23C 18/38*** | (2006.01) |
| ***C23C 18/42*** | (2006.01) |

(52) U.S. Cl. ..... 106/1.22; 106/1.23; 106/1.25; 106/1.26; 106/1.27; 106/1.29

(58) Field of Classification Search ..... 106/1.22, 106/1.23, 1.25, 1.26, 1.27, 1.29
See application file for complete search history.

(56) References Cited

U.S. PATENT DOCUMENTS

| | | | | |
|---|---|---|---|---|
| 3,898,052 | A * | 8/1975 | Dean et al. | 428/632 |
| 4,927,472 | A * | 5/1990 | Matsushima et al. | 148/261 |
| 5,310,419 | A | 5/1994 | McCoy et al. | |
| 5,540,788 | A | 7/1996 | Defalco et al. | |
| 5,985,308 | A | 11/1999 | Burrell et al. | |
| 6,755,917 | B2 | 6/2004 | Hardin et al. | |
| 6,897,349 | B2 | 5/2005 | Gibbins et al. | |
| 7,087,104 | B2 | 8/2006 | Choi et al. | |
| 2003/0000418 | A1 | 1/2003 | Boulos | |
| 2008/0302267 | A1 * | 12/2008 | Defalco | 106/1.23 |

OTHER PUBLICATIONS

Krim, Jacqueline, "Friction at the Atomic Scale", Scientific America, Oct. 1996, pp. 74-80, Scientific America, Inc., published in U.S.

* cited by examiner

*Primary Examiner* — Helene Klemanski
(74) *Attorney, Agent, or Firm* — Gerald M. Walsh; Kenneth M. Bush; Bush Intellectual Property Law

(57) ABSTRACT

The present invention provides compositions and processes for preparing metallic ions for deposition on and/or into conductive substrates, such as metals, to substantially eliminate friction from metal to metal contact. It is used in the aqueous embodiment to form new metal surfaces on all metal substrates. The processes form stable aqueous solutions of metal and metalloid ions that can be adsorbed or absorbed on and/or into conductive substrates. The aqueous solutions consist of ammonium alkali metal phosphate salts, and/or ammonium alkali metal sulfate salts mixed with a water soluble metal or metalloid salt from Group I through Group VIII of the periodic table of elements. The aqueous solutions allow for a nano deposition of the metal ions on and/or into the surfaces of conductive substrates. The surfaces created by the deposited metal ions will provide metal passivation and substantially eliminate friction in metal-to-metal contact without the use of hydrocarbon based lubricants.

18 Claims, 13 Drawing Sheets

Far70423arg on SS 50x

Far70423arg on SS 500x

Far70423arg on SS 2000x

Far70423arg on SS 50x

Far70423arg on SS 500x

Far70423arg on SS 2000x

Far70423 si on al 50x

Far70423 si on al 500x

Far70423 si on al 2000x

Far70423 si on SS 50x

Far70423 si on SS 500x

Far70423 si on SS 2000x

Far70423 zn on al 50x

Far70423 zn on al 500x

Far70423 zn on al 2000x

Far70423al 50x

Far70423al 500x

Far70423al 2000x

Far70423cu 50x

Far70423cu 500x

Far70423cu 2000x

Far70423mo 50x

Far70423mo 500x

Far70423mo 2000x

Far70423mo on SS 50x

Far70423mo on SS 500x

Far70423mo on SS 2000x

Far70423oilph 50x

Far70423oilph 500x

Far70423oilph 2000x

COMPOSITIONS AND PROCESSES FOR DEPOSITION OF METAL IONS ONTO SURFACES OF CONDUCTIVE SUBSTRATES

REFERENCE TO RELATED PATENT APPLICATIONS

The present application is a continuation-in-part of U.S. patent application Ser. No. 12/025,506, filed Feb. 4, 2008, now abandoned, which claims priority to U.S. Provisional Patent Application No. 60/933,242, filed Jun. 5, 2007.

BACKGROUND OF THE INVENTION

1. Field of the Invention

The present invention relates to compositions and processes for coating metals and, more particularly, to aqueous compositions of metals for coating metal surfaces, and processes for making these aqueous compositions.

2. Technical Background

Many methods have been developed to form new conversion surfaces on commodity metals such as ferrous metals, steel, stainless steel, aluminum, zinc and titanium. These methods include electroplating, phosphating (conversion surfaces), chemical vapor deposition, ion sputtering, and other techniques. An early electroplating method for silver was developed in England in 1870. Later, methods of plating noble metals, i.e. copper and gold were developed. These metals had to be complexed with cyanide to make an adherent deposit on the substrate material. The use of cyanide is still the preferred method of forming an adherent first deposit of noble metals on substrates. Cyanide, an extremely toxic material, is an environmental hazard and a danger to public health. Numerous safety procedures have to be in place to use cyanide, and even then users may be subjected to fumes that are dangerously toxic. As electroplating technology has unfolded over the years, techniques to electroplate other elements such as zinc, cadmium, nickel, and chromium were developed and became widely used in the commercial world for engineering and decorative purposes.

Electroplated deposits on a substrate surface do not go into the metal interstices of the surface. As a result the deposits are not tenacious enough to maintain their integrity when the substrate is "cold worked" to yield point. Zinc electrodeposits are destroyed by cold working at 61,000 PSI, cadmium at 69,000 PSI, while the steel substrate will have a yield point of 80,000 PSI or stronger. This has always been a significant problem in the electroplating industry. The electroplater has to deal with many different parameters to create efficient deposition procedures to accomplish desired end results. Electroplating requires procedures for pretreatment, precleaning, and rinsing controlled plating baths, and special anodes. Electroplating generally follows the rules of the Electromotive Series that a more noble metal can be plated on a less noble metal, but not the reverse direction. This limits the ability to plate all the metals in the periodic table onto other metal substrates in the periodic table.

Another method of surface modification is phosphating, wherein a phosphate conversion surface is formed on steels and aluminum. Phosphate conversion surfaces are widely used for corrosion inhibition and as a base for paints. Phosphating is one of the most widely used techniques in the commercial world with major uses in the auto industry as an undercoat to inhibit corrosion and as an anchor to retain paint.

Conversion coating phosphating methods require large plating baths and are energy intensive and time consuming. Phosphating requires at least ten minutes or longer to get a commercially acceptable, adherent conversion surface. The industry has developed many accelerants over the years to speed up the conversion process.

In the latter part of the $20^{th}$ century, new and exotic techniques were developed to obtain better surfaces on metals. These methods modified the metals with a coating on a substrate by vapor deposition techniques such as vacuum evaporation, sputtering, magnetron sputtering, or ion plating. These techniques can be used to harden metal surfaces such as metal working tools including tungsten carbide inserts, drills, hobbs, etc. Chemical vapor deposition is applied in a vacuum chamber and the metal is ionized in a nitrogen atmosphere and deposited on and diffuses into the substrates. Some examples of the results of these techniques are titanium nitride and boron nitrides. The deposition is generally by line of sight and the process is limited to the shape, size and configuration of the substrate metals. This process is expensive, requiring special equipment and high energy usage. The deposits are formed under exacting conditions of temperature, gas composition, etc. These techniques result in deposits that have dense, smooth, defect free surfaces useful for many commercial products.

Many metals form a passive oxide surface that are beneficial in protecting the metal from corrosion. Such metals are aluminum and stainless steels and titaniums. The oxide film that forms on stainless steel is a mono-molecular layer that renders the surface passive. The oxide layer that forms on carbon steel is deleterious to the metal and is called rust.

U.S. Pat. No. 6,755,917, issued to Hardin, et al. describes a solution for providing conversion coating on the surface of a metallic material. The solution includes a peroxidic species and is limited to at least one metal from Group IB, IIB, IVA, VA, VIA AND VIII of the periodic table. Specifically, Hardin also provides a liquid acidic aqueous concentrate for the replenishing of a conversion coating solution according to the invention, wherein the concentrate contains rare earth ions (as herein defined) and monovalent anions in a molar ratio of total rare earth ions:monovalent anions of from 1:200 to 1:6 and/or rare earth ions and divalent anions in a molar ratio of total rare earth ions:divalent anions of from 1:100 to 1:3 and/or the concentrate contains at least one metal selected from Groups IB, IIB, IVA, VA, VIA and VII, preferably from the group of Cu, Ag, Au, Cd, Hg, Ni, Pd, Pt, Co, Rh, Ir, Ru, Os, Sn, Pb, Sb, Bi, Se and Te and anions such that the molar ratio of the sum of the elements in this group:anions is in the range from 1:50 to 1:10,000. Further, the Hardin methods are limited to an acidic aqueous solution.

It is known that thin mono-molecular oxide films present on stainless steel can provide an excellent passivation surface to metals. It has been theorized that corrosion may one day be conquered by a thin molecular layer on metal surfaces. It has been further theorized that significant reductions in friction could be obtained with thin, tenacious metallic films.

In the October 1996 issue of Scientific American, Jacqueline Krim, PhD, published a paper titled "Friction at the Atomic Scale". Her findings led to the conclusion that "at the atomic level with metal to metal contact there is no friction." This surprising finding called into question many of the beliefs that friction was a condition that could only be alleviated by the use of a lubricant to reduce the heat generated by metals sliding over one another. Another surprising conclusion was that, at the atomic level, "friction arises from atomic lattice vibrations when atoms close to the surface are set into motion by the sliding action of atoms in the opposing surface. These vibrations are really sound waves. In this way, some of the mechanical energy needed to slide one surface over the other, is converted to sound energy, which is eventually transformed into heat." Heat causes friction. To maintain the sliding, more mechanical energy must be added. Krim further posits "Solids vibrate only at certain distinct frequencies, so the amount of mechanical energy depends on the frequencies actually excited. If the atoms in the opposing surface resonates with the frequency of the other surface, then friction arises. But if the opposing surface is not resonant with any of the other surface's own frequencies, then sound waves are not generated. This feature opens the exciting possibility that sufficiently small solids, which have relatively few resonant frequencies, might exhibit nearly frictionless sliding."

Another surprising result of her work was that dry films were slipperier than liquid films. This was counterintuitive to all current thought on friction. Further tests by other scientists validated that metal to metal contact at the atomic level eliminated friction, and that liquid lubricants caused friction with the "stick/slip" action. The liquid would stick in the gaps in the metal and then slip out. This caused vibrations in the lattices and generated sound waves which converted to heat, causing friction.

Estimates are that friction reduction could save up to 1.6% of Gross National Product or over two hundred billion dollars annually. Hence, a process that virtually eliminates friction on commodity metals would be new and useful but has never been available. It is clear that such a process would have great value and aid in the nation's quest for energy independence and greatly reduce infrastructure replacement costs for corroding metal structures, underground pipelines, storage tanks, bridges and overpasses.

Phosphate conversion surfaces are used in commercial plants to reduce decibel levels. High decibel levels are an ongoing workplace hazard and are detrimental to human health causing early hearing loss. Governmental regulatory agencies such OSHA and the EPA are constantly urging industry to develop lower decibel levels in manufacturing operations. Therefore any conversion surface that reduces decibel levels would be advantageous for human health and improving the work place environment.

U.S. Pat. No. 7,087,104 issued to Choi et al., describes a system and method for storing a solution containing a subset of a group consisting of a metal ion, a complexing agent, an ammonium salt, and a strong base. Near the time of use, the solution is used to form an electroless deposition solution containing the entire group. In one embodiment of the invention, the metal ion includes a cobalt ion, the complexing agent includes citric acid, the ammonium salt includes ammonium chloride, and the strong base includes tetramethylammonium hydroxide. The base solution is prepared and then set aside for 2 days to allow for stabilization prior to use. Another solution has to be prepared and then mixed with the first solution just prior to use in a plating bath. This requires complex logistics and skilled operators to make the final preparation at the plant bath site.

In U.S. Pat. No. 5,310,419 issued to McCoy et al. methods are disclosed for preparing electrolyte solutions for electroplating of metals and other uses. It was discovered that with the use of an external electromotive source that all metals in the Periodic table could be electrodeposited on conductive substrates. McCoy et al teach that the process of making their solutions requires adding acid and base together rapidly, producing a violent exothermic reaction to avoid ammonia loss. McCoy et al's electrolyte solutions prepared in this manner do not provide for deposition of a non-alkaline metal on a surface without the use of applied external electromotive force, and do not provide for the deposition of phosphorus or sulfur and nitrogen on a surface simultaneously with the deposition of a non-alkaline metal.

U.S. Pat. No. 5,340,788 issued to Defalco, et al., discloses a method for preparing an oil additive that is applied to parts of internal combustion engines using the lubricating oil as the carrier fluid. The solution is mixed with a polyethylene glycol for introduction into the lubricating oil.

SUMMARY OF THE INVENTION

The present invention provides compositions and processes for preparing metallic ions for deposition on and/or into conductive substrates, such as metals, to substantially eliminate friction from metal to metal contact. It is used in the aqueous embodiment to form new metal surfaces on all metal substrates. The processes form stable aqueous solutions of metal and metalloid ions that can be adsorbed or absorbed on and/or into conductive substrates. The aqueous solutions consist of ammonium alkali metal phosphate salts, and/or ammonium alkali metal sulfate salts mixed with a water soluble metal or metalloid salt from Group I through Group VIII of the periodic table of elements. The aqueous solutions allow for a nano deposition of the metal ions on and/or into the surfaces of conductive substrates. The surfaces created by the deposited metal ions will provide metal passivation and substantially eliminate friction in metal-to-metal contact without the use of hydrocarbon based lubricants.

The process of the present invention for the production of ion complexes is performed in an aqueous reaction medium, and the ion complexes are used as an aqueous solution in the forming of conversion surfaces on metallic objects. To prepare the inorganic ion complexes the following reactants are required: (a) at least one water soluble non-alkaline metal salt selected from Groups I-VIII of the Periodic Table; (b) an alkali metal hydroxide; c) a sulfur-containing compound and/or a phosphorous containing compound, such as mineral acids; d) ammonium hydroxide; and e) water. A parent solution A can be produced when the reactants orthophosphoric acid, water, ammonium hydroxide and an alkali metal hydroxide are mixed together. An exothermic reaction occurs and the temperature of the aqueous solution is approximately 100° C. A measured amount of a metallic salt such as silver nitrate, zinc oxide, aluminum salts such as aluminum sulfate, ammonium molybdate, ammonium tungstate or any water soluble metal salt can then be introduced into the reaction vessel, stirred and heated until the metallic salt is totally dissolved in the aqueous medium. A parent solution B can be produced when the reactants sulfuric acid, water, ammonium hydroxide and the alkali metal hydroxide are mixed together. An exothermic reaction occurs and the temperature of the aqueous solution is approximately 100° C. A measured amount of a metallic salt, such as boric acid, or copper sulfate, or ammonium molydate can then be introduced into the reaction vessel and dissolved. The metallic ions then become soluble in the aqueous solution and do not precipitate and remain stable. The alkali metal hydroxide can be any hydroxide of a metal in Group IA of the Periodic Table, principally sodium hydroxide, potassium hydroxide, lithium hydroxide, with potassium hydroxide being the preferred reactant.

The aqueous solutions of metals also deposit nitrogen on the surface of metals. Wear tests show that metal coatings created by application of the aqueous solutions reduce wear of metal as effectively as oil-based lubricants.

An advantage of the present invention is that the solution can be applied to any structure, regardless of configuration with none of the disadvantages and limitations of the current electroless, chemical vapor or electroplating technology in commercial use today.

Another advantage is a ground stable solution that can be shipped to any location.

Another advantage is a simplified process using an aqueous solution for forming a conversion coating on a metallic material.

Another advantage is the creation of an oxide free conversion surface to all metallic substrates.

DETAILED DESCRIPTION OF THE PREFERRED EMBODIMENTS

Figure 1:
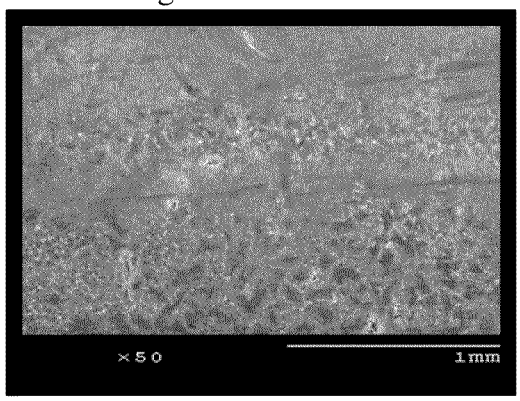
FIG. 1 shows deposits of silver-phosphorous-potassium on stainless steel.
Figure 1:
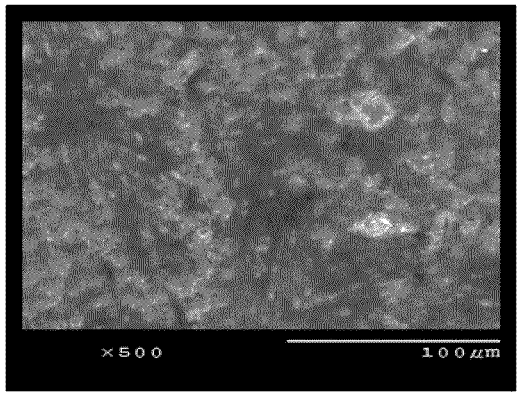
Figure 1:
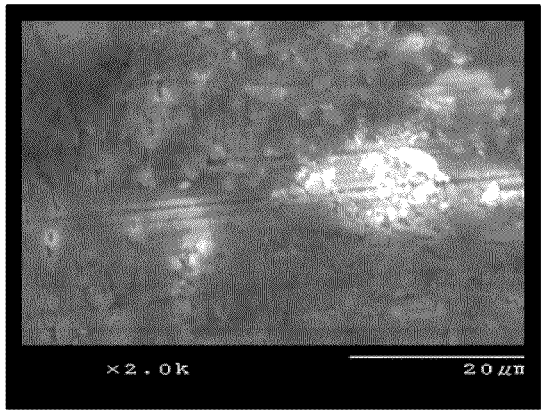

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

There is a need for an inexpensive, efficacious, easy to apply technique to reduce metal to metal friction at the atomic level. Surprisingly, when metal ions are produced according to the present invention, the ions so produced diffuse into metal interstices. Surprisingly, the ions produced do not follow the rules of the Electromotive Series, i.e. aluminum can be deposited on ferrous metals, which is not anticipated in any previous literature. Surprisingly, silver ions generated by the present invention remain photo stable in aqueous solution in the presence of sunlight. Ionic photo stable silver can be achieved only through expensive techniques by ion sputtering, as described in U.S. Pat. No. 5,985,308 or by methods described in U.S. Pat. No. 6,897,349 involved with complexing with different solvents such as alcohols and a chloride anion donating compound. Ionic Silver has been the subject of much research. Although there are many known methods of stabilizing ionic silver, none of these use an aqueous solution. Deposition of an adherent silver surface on metallic pieces by mere immersion, brushing, or spraying would be of great value. Ionic silver that is stable in aqueous solution would have wide applications in electronics and in medicine, for example, for its antimicrobial properties in bandages for wound healing and for forming an anti-microbial surface on medical instruments.

The present invention does not require the use of applied external electromotive force, but forms a thin tenacious metallic film on substrates by mere immersion, brushing or spraying. The surprising finding of this invention is that the new conversion surface can be made to deposit in a monomolecular layer onto and into the substrate. Most plating specifications require thickness of the deposits of one mil (23-24 microns). The present invention provides permanent thin films on conductive substrates, from 0.05 to 10 microns thickness.

The process of the present invention for the production of ion complexes is performed in an aqueous reaction medium, and the ion complexes are used as an aqueous solution in the forming of conversion surfaces on metallic objects. To prepare the inorganic ion complexes the following reactants are required: a) at least one water soluble non-alkaline metal salt selected from Groups I-VIII of the Periodic Table; b) an alkali metal hydroxide; c) a sulfur-containing compound and/or a phosphorous containing compound, such as mineral acids; d) ammonium hydroxide; and e) water.

The non-alkaline metal salt reactant may be from any non-alkaline metal of Groups I-VIII of the Periodic Table. Representative, non-limiting examples of applicable non-alkaline water soluble metals salts include those derived from: Group I-B: copper, silver, gold; Group II-A: beryllium, magnesium; Group II-B: zinc, cadmium; Group III-A: aluminum, gallium, indium; Group IV-A: silicon, tin, lead; Group IV-B: titanium, zirconium, hafnium; Group V-A: antimony, bismuth; Group V-B: vanadium, niobium, tantalum; Group VI-A: selenium, tellurium; Group VI-B: chromium, molybdenum, tungsten; Group VII-B: manganese; and Group VIII: iron, cobalt, nickel, palladium rhodium.

While silicon, as a member of Group IV-A, is considered to be a metalloid and is not generally defined as a metallic element, silicon acts in the method of the present invention as a non-alkaline metal. Accordingly, the expression "non-alkaline metal of Groups I-VIII of the Periodic Table" is meant to embrace any and all of the above and equivalent metals, including silicon. As will be further recognized, the term "non-alkaline metal of Groups I-VIII of the Periodic Table" does not embrace the alkali metals of Group I-A. The alkaline earth metals, calcium, strontium, and barium of Group II-A, are similarly not within the scope of the term. On the other hand, beryllium and magnesium of Group II-A can be applicably employed in the practice of this invention and these metals also fall within the scope of the expression "non-alkaline metal of Groups I-VIII of the Periodic Table" as used herein. Combinations of the non-alkaline metal salts may also be used.

A parent solution A can be produced when the reactants orthophosphoric acid, water, ammonium hydroxide and an alkali metal hydroxide are mixed together. An exothermic reaction occurs and the temperature of the aqueous solution is approximately 100° C. A measured amount of a metallic salt such as silver nitrate, zinc oxide, aluminum salts such as aluminum sulfate, ammonium molybdate, ammonium tungstate or any water soluble metal salt can then be introduced into the reaction vessel, stirred and heated until the metallic salt is totally dissolved in the aqueous medium. The alkali metal hydroxide can be any hydroxide of a metal in Group IA of the Periodic Table, principally sodium hydroxide, potassium hydroxide, lithium hydroxide, with potassium hydroxide being the preferred reactant. Combinations of these alkali metal hydroxides may also be used.

Preparation of Parent Solution A

Into a reaction vessel add about 0.5 to 1.5 liters, preferably about 1.0 liter, of water and about 0.5 to 1.5 liters, preferably about 1.0 liter, of orthophosphoric acid, about 75% to 85%, preferably about 80%, by volume. Then add about 0.5 to 1.5 liters, preferably about 1.0 liter, of ammonium hydroxide, about 15-35%, preferably about 26%, by volume. The ammonium hydroxide must be added slowly to the orthophosphoric acid over a period of time sufficient to prevent a violent exothermic reaction. Preferably, the ammonium hydroxide should be added over a period of at least seven minutes or more so that the violent exothermic reaction will not occur. Then add about 0.5 to 1.5 liters, preferably about 1.0 liter, of potassium hydroxide, about 20-60%, preferably about 49%, by volume. Allow the liquid to cool to ambient conditions.

A parent solution B can be produced when the reactants sulfuric acid, water, ammonium hydroxide and the alkali metal hydroxide are mixed together. An exothermic reaction occurs and the temperature of the aqueous solution is approximately 100° C. A measured amount of a non-alkaline metal salt, such as boric acid, or copper sulfate, or ammonium molydate can then be introduced into the reaction vessel and dissolved. The metallic ions then become soluble in the aqueous solution and do not precipitate and remain stable. The alkali metal hydroxide can be any hydroxide of a metal in Group IA of the Periodic Table, principally sodium hydroxide, potassium hydroxide, lithium hydroxide, with potassium hydroxide being the preferred reactant. Combinations of these alkali metal hydroxides may also be used.

Preparation of Parent Solution B

Into a reaction vessel add about 1 to 3 liters, preferably about 2 liters, of water and about 0.5 to 1.5 liters, preferably about 1 liter, of concentrated sulfuric acid, about 75% to 85%, preferably about 80%, by volume. Then add about 0.5 to 1.5 liters, preferably about 1 liter, of ammonium hydroxide, about 15-35%, preferably about 26%, by volume. The ammonium hydroxide must be added slowly to the sulfuric acid over a period of time sufficient to prevent a violent exothermic reaction. Preferably, the ammonium hydroxide should be added over a period of at least seven minutes or more so that the violent exothermic reaction will not occur. Then add about 0.5 to 1.5 liters, preferably about 1.0 liter, of potassium hydroxide, about 20-60%, preferably about 49%, by volume. Allow the liquid to cool to ambient conditions.

Example of a Silver Nitrate Parent Solution A

Using about 80 to 120 ml, preferably about 100 ml, of Parent A solution, adjust the solution pH to approximately 7 using phosphoric acid. Add about 0.1-10 grams, preferably about 1 gram, of silver nitrate to the solution. Stir and heat until the silver salt is completely dissolved in the solution. Immerse a coupon of 1010 steel in the silver nitrate solution for one minute. A thin, tenacious, bright film of silver is formed on the steel coupon. The surface is examined using Scanning Electron Microscopy (SEM). It is not known for silver to form an adherent deposit on steel except by use of a cyanide solution and applied external electromotive force. The present process of silver deposition can be performed without the presence of cyanide and applied external electromotive force to produce a tenacious non-immersion deposit. The silver nitrate solution can be placed in a glass container and exposed to sunlight for several weeks. The silver does not become photosensitive, indicating that silver can be stabilized by the inexpensive process of the present invention which would be widely useful in areas such as antimicrobial activity and protection of the surfaces of medical instruments. A 2"×2' sheet of Alcoa aluminum foil wrap can be contacted with the silver nitrate solution and then rubbed into the surface. The surface of the aluminum foil will be coated with a film of silver. A 410 stainless steel coupon can be immersed in the silver nitrate solution for one minute. A thin tenacious film of silver will be formed on the stainless steel.

A cotton gauze bandage can be immersed in the silver solution and then exposed to sunlight for several days. The bandage will not turn black as expected when ionic silver is exposed to sunlight, indicating the usefulness of the treated bandage use as an anti-microbial bandage for health and wound healing. The gauze treated bandage can be subjected to a flame from a propane torch. The cotton will be charred when in direct contact with the flame tip, but the gauze does not ignite, indicating a use of the silver solution as a flame retardant for fabrics.

Example of an Ammonium Molybdate Parent Solution A

Using about 80 to 120 ml, preferably about 100 ml, of Parent solution A add about 0.1-10 grams, preferably about 1 gram, of ammonium molybdate to the solution. Stir and heat until the ammonium molybdate is completely dissolved. Immerse a 1010 steel coupon in the solution for one minute. A thin, tenacious film of molybdenum is formed on the steel coupon. A strip of aluminum foil 2"×2" was immersed in the solution for 30 seconds. A thin deposit of molybdenum formed on the aluminum coupon. In "Electroplating' Frederick A Lowenheim, McGraw Hill Book company, page 141 states "from the standpoint of their electrode potentials, it should be possible to electroplate such metals as tungsten and molybdenum from aqueous solutions with a pH of about 5. Nevertheless (in spite of claims in the literature), these metals cannot be deposited in pure form from aequous solutions." Thus the present invention provides an unexpected method for forming a molybdenum surface on steel and other conductive substrates.

Example of an Ammonium Tungstate Parent Solution A

Using about 80 to 120 ml, preferably about 100 ml of Parent solution A add about 0.1-10 grams, preferably about 1 gram, of ammonium tungstate to the solution. Stir and heat until the metallic salt is completely dissolved. Immerse a 1010 steel strip in the solution for one minute. A thin, bright, tenacious film of tungsten has formed on steel strip. As was the case with molybdenum, the present invention provides an unexpected method of forming a tungsten surface on steel.

Example of a Parent Copper Sulfate Parent Solution B

Using about 80 to 120 ml, preferably about 100 ml of Parent Solution B add about 0.1-10 grams, preferably about 1 gram, of copper sulfate to the solution. Stir and heat until the metallic salt is completely dissolved in the solution. Immerse a 1010 steel panel in the solution for up to two minutes. An adherent, visible copper deposit forms on the steel coupon. The only practical way to deposit adherent copper plates on active metals such as zinc and steel is to use a cyanide bath. In spite of many efforts to dispense with cyanide-containing plating baths because of environmental restriction, no practical substitute for the cyanide copper bath has been developed. It is known that copper without cyanide and applied external electromotive force will form an immersion deposit which is valueless. A standard ASTM test for an adherent deposit is to place plastic adhesive tape on the plated surface and pull the tape. If the deposit is an immersion deposit, the copper will peel off with the tape. If the deposit is adherent, then the copper will not peel off with the plastic adhesive tape. When plastic adhesive tape was applied to the copper surface in this example, the copper film remained adherent.

Example of an Aluminum Sulfate Parent Solution B

Using about 80 to 120 ml, preferably about 100 ml, of Parent solution B add about 0.1-10 grams, preferably about 2 grams, of aluminum sulfate to the solution. Stir and heat the solution until completely dissolved. Immerse a coupon of 1010 steel in the solution for 1 minute. A thin, tenacious, shiny adherent film of aluminum is formed on the steel coupon.

Example of a Boric Acid Parent Solution B

Using about 80 to 120 ml, preferably about 100 ml, of Parent solution B add about 0.1-10 grams, preferably about 2 grams, of boric acid to the solution. Stir and heat until completely dissolved. Immerse a 1010 steel coupon in the solution for one minute. A thin, tenacious bright film of boron is formed on the steel coupon. A coupon of aluminum foil 2"×2" was immersed in the solution. A thin film of boron formed on the aluminum. A stainless steel coupon was immersed in the solution and a thin metallic film of boron formed on the stainless steel.

Example of an Ammonium Tungstate Parent Solution B

Using about 80 to 120 ml, preferably about 100 ml, of Parent solution B add 2 ml of ammonium tungstate, 12% by volume to the solution. Stir and heat until thoroughly dissolved. Immerse a 1010 steel coupon in the solution for one minute. A thin, tenacious bright metallic film of tungsten is formed on the steel surface.

Example of a Combination of Parent Solution a and Parent Solution B

Combine about 160 ml of Parent solution A and about 40 ml of parent solution B. Raise the pH of the solution, combined to above 12 with potassium hydroxide by adding about 10 ml of potassium hydroxide, about 49% by weight. Heat and stir until the potassium hydroxide is completely dissolved. This solution can be misted into a hydrocarbon stream such as natural gas or vaporized gasoline in an internal combustion engine to enhance fuel combustion. The solution may be misted into the air intakes of internal combustion engines to increase the volume of air available for combustion to enhance fuel economy.

Example of an Oil Derivate of the Combination of Parent Solution A and Ammonium Tungstate Parent Solution B About 160 ml of Parent Solution A and about 40 ml of ammonium tungstate Parent Solution B are blended together. Using about 200 ml of highly refined mineral oil, blend into the mineral oil about 20 ml (10% by volume) of the mixed solution of Parent Solution A and ammonium tungstate Parent Solution B. Dehydrate this oil solution to drive off the water and precipitate the salts by raising the temperature above 100° C. When the oil solution becomes bright and clear, allow the oil to cool down and then decant the oil. The decantate can then be used as an oil additive or as a fuel additive. It is well known that tungsten has catalytic properties. Any metal such as platinum, iron, etc, that has catalytic properties can be used by this technique for manufacturing a fuel and lubricant additive.

Examples of Conversion Surfaces

Figure 2:
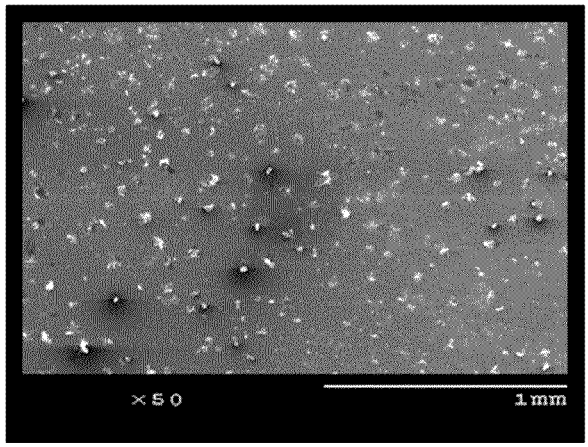
FIG. 2 shows deposit of silicon-phosphorous-potassium on aluminum.
Figure 2:
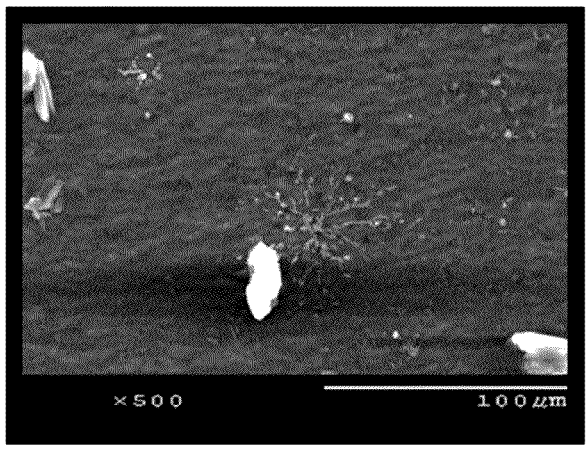
Figure 2:
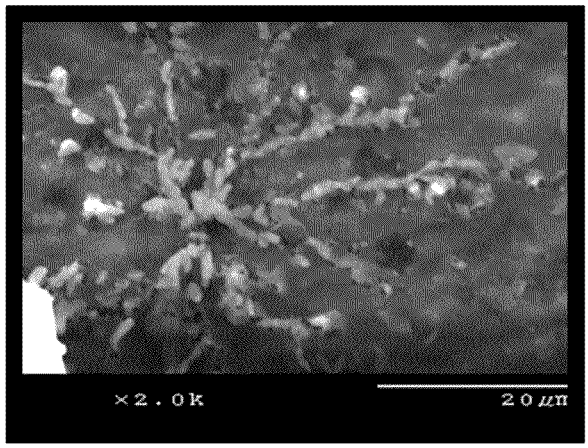
Figure 3:
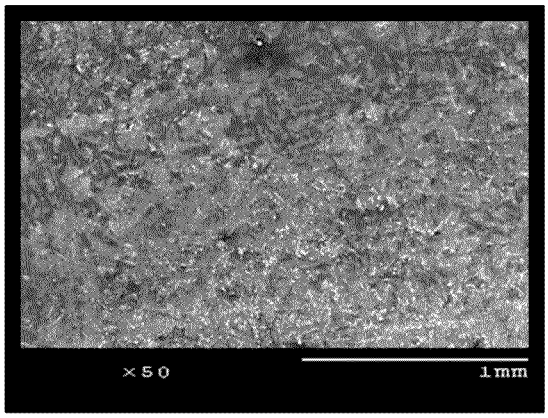
FIG. 3 shows deposit of silicon-phosphorous-potassium on stainless steel.
Figure 3:
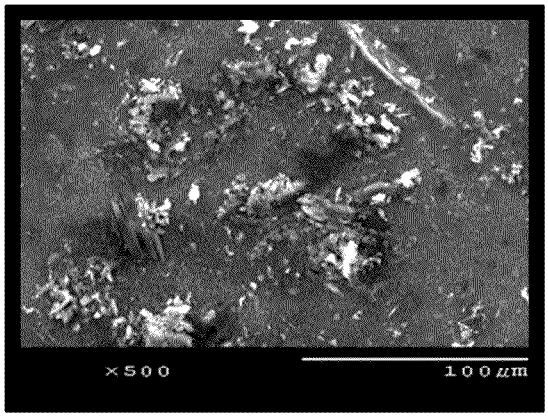
Figure 3:
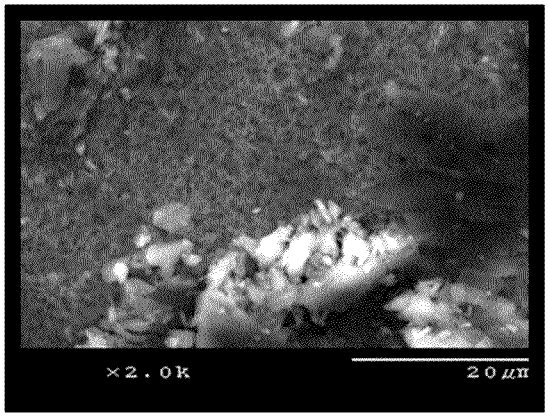
Figure 4:
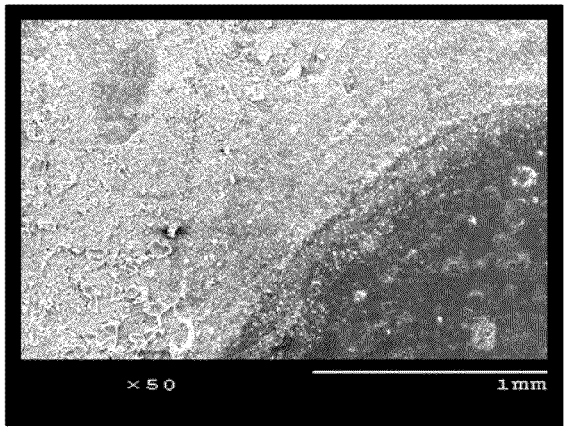
FIG. 4 shows deposit of zinc-phosphorous-potassium on aluminum.
Figure 4:
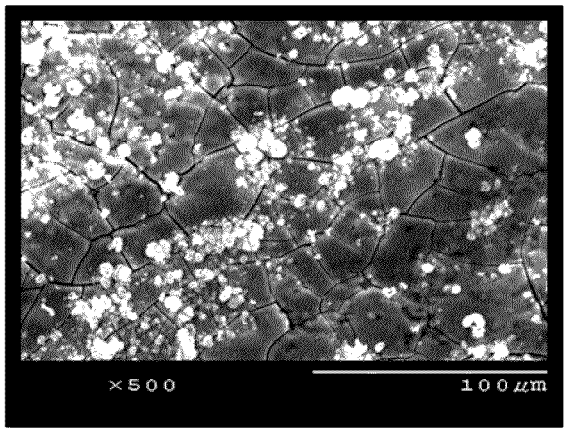
Figure 4:
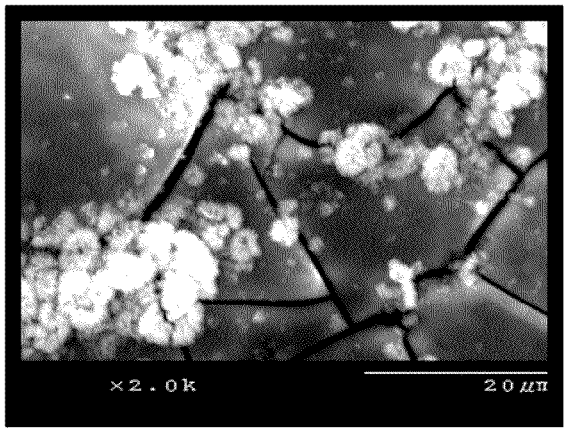
Figure 5:
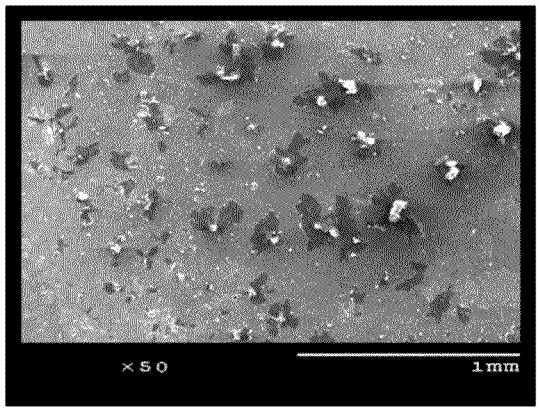
FIG. 5 shows deposit of aluminum-phosphorous-potassium on 1010 carbon steel.
Figure 5:
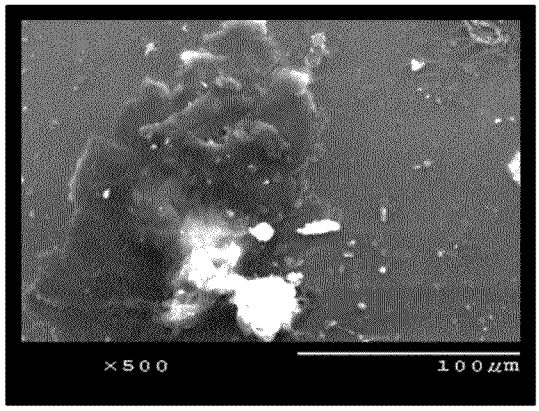
Figure 5:
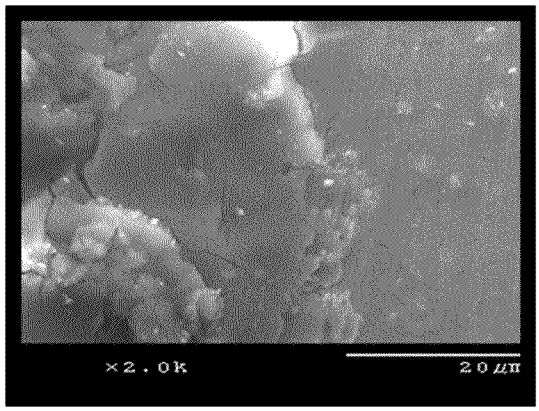
Figure 6:
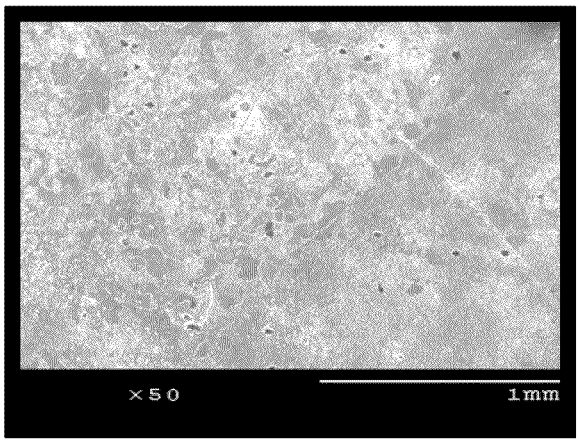
FIG. 6 shows deposit of copper-phosphorous-potassium on 1010 carbon steel.
Figure 6:
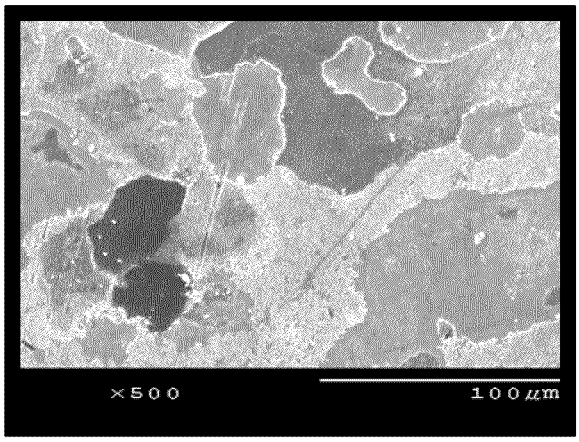
Figure 6:
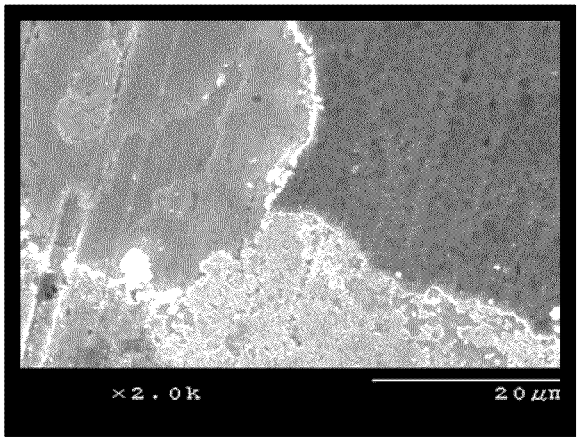
Figure 7:
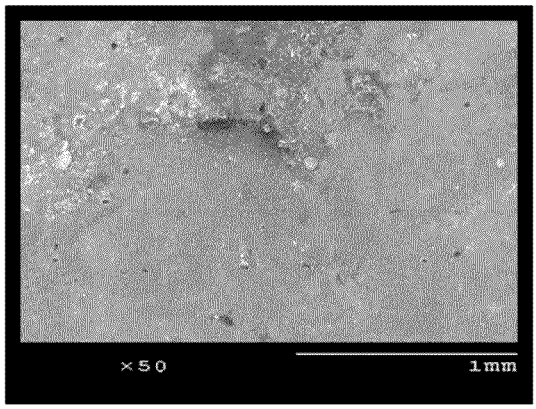
FIG. 7 shows deposit of molybdenum-phosphorous-potassium on 1010 carbon steel.
Figure 7:
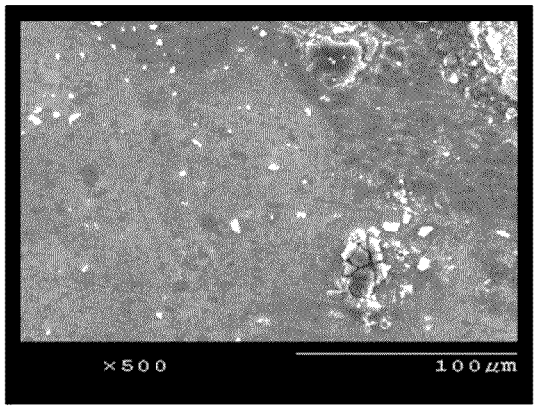
Figure 7:
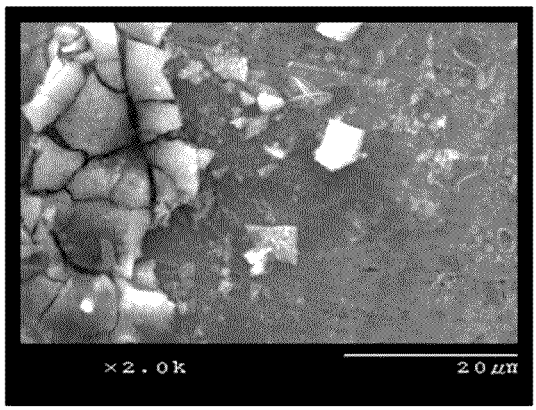
Figure 8:
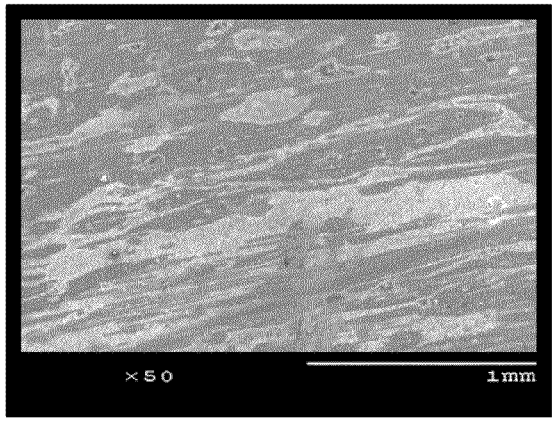
FIG. 8 shows deposit of molybdenum-phosphorous-potassium on stainless steel.
Figure 8:
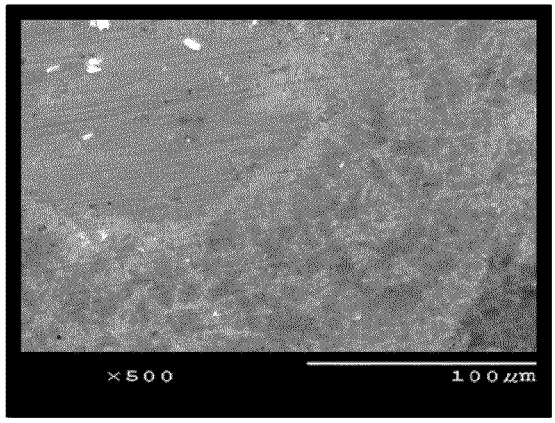
Figure 8:
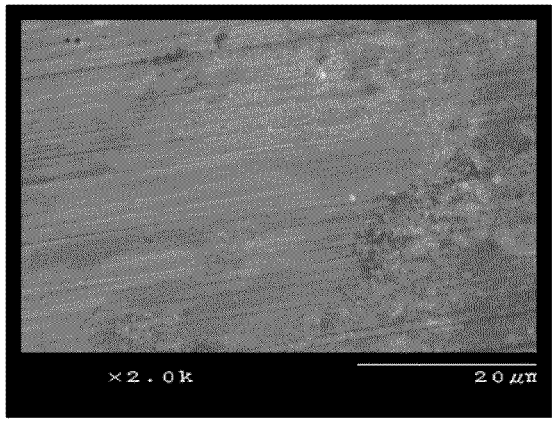
Figure 9:
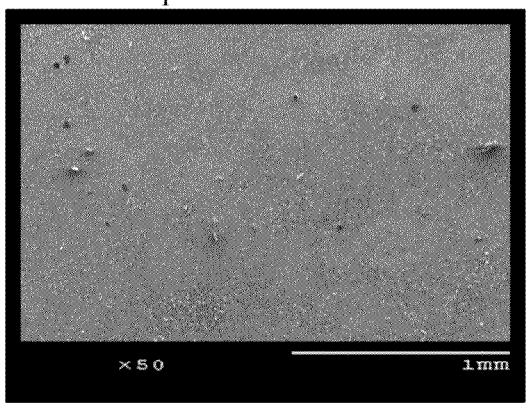
FIG. 9 shows deposit of silicon-phosphorous-potassium on 1010 carbon steel panel deposited from oil phase.
Figure 9:
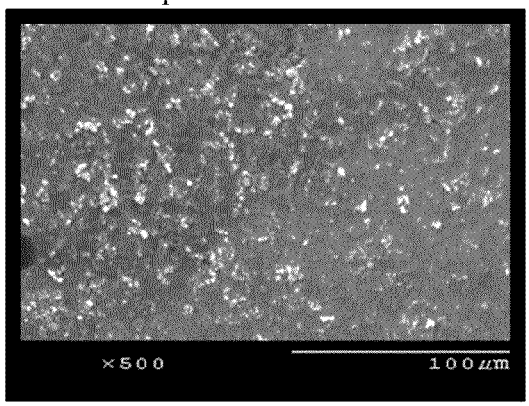
Figure 9:
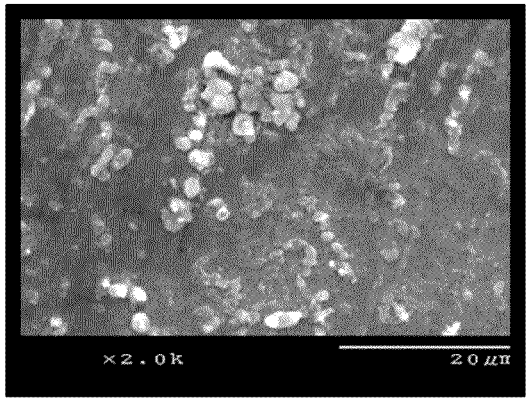

Three substrate materials were chosen: aluminum foil made by ALCOA, 1010 carbon steel, and 400 series stainless steel. These substrate metals were chosen as representative of the most widely used metals in the world. The metal ion solutions were chosen to show that any metal ion produced by this invention can be deposited on and into various metal substrates, resulting in new metallic surfaces heretofore unknown. The metal ion solutions were prepared according to parent solution A. Samples were not pretreated to remove oxides, soils, rust or oils, but were immersed for 30 seconds each at ambient conditions and dried using ambient air and a paper towel. Samples were then examined by EDS (Electron dispersive spectroscopy) by Vista Engineering of Birmingham, Ala. These results are as shown on the analytical charts in FIGS. 1-9. FIG. 1 shows deposits of silver-phosphorous-potassium on stainless steel. FIG. 2 shows deposit of silicon-phosphorous-potassium on aluminum. FIG. 3 shows deposit of silicon-phosphorous-potassium on stainless steel. FIG. 4 shows deposit of zinc-phosphorous-potassium on aluminum. FIG. 5 shows deposit of aluminum-phosphorous-potassium on 1010 carbon steel. FIG. 6 shows deposit of copper-phosphorous-potassium on 1010 carbon steel. FIG. 7 shows deposit of molybdenum-phosphorous-potassium on 1010 carbon steel. FIG. 8 shows deposit of molybdenum-phosphorous-potassium on stainless steel. FIG. 9 shows deposit of silicon-phosphorous-potassium on 1010 carbon steel panel deposited from oil phase. Similar results occur when sulfuric acid is used in place of orthophosphoric acid, except that sulfur is deposited instead of phosphorous.

Figure 10:
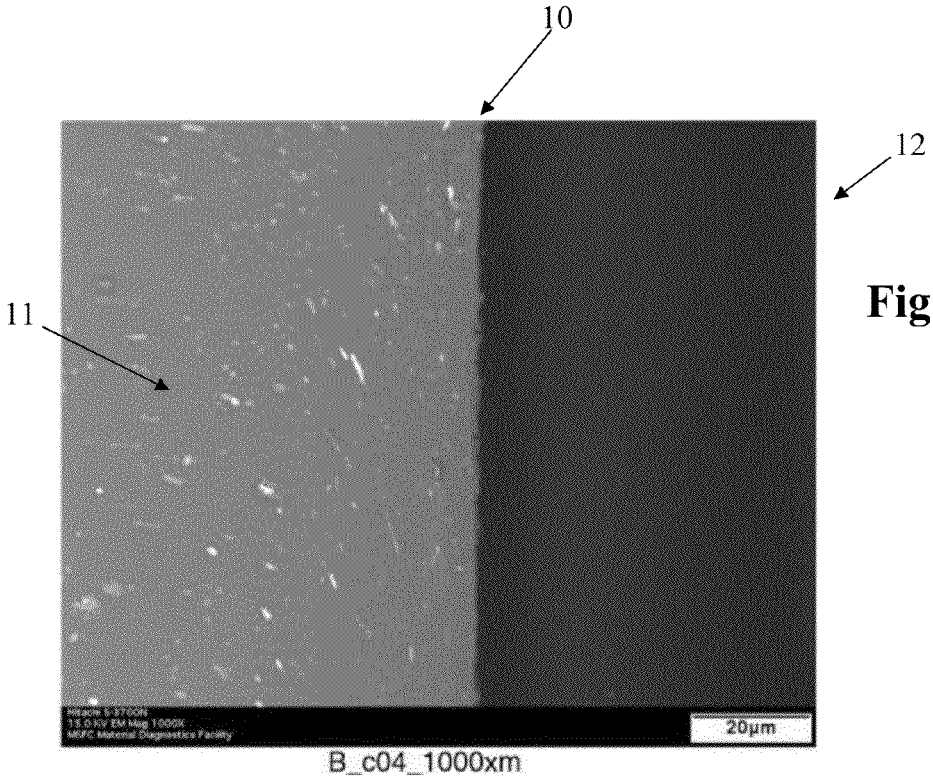
FIG. 10 shows the thickness of a boron coating on aluminum from scanning electron microscope images.
Figure 11:
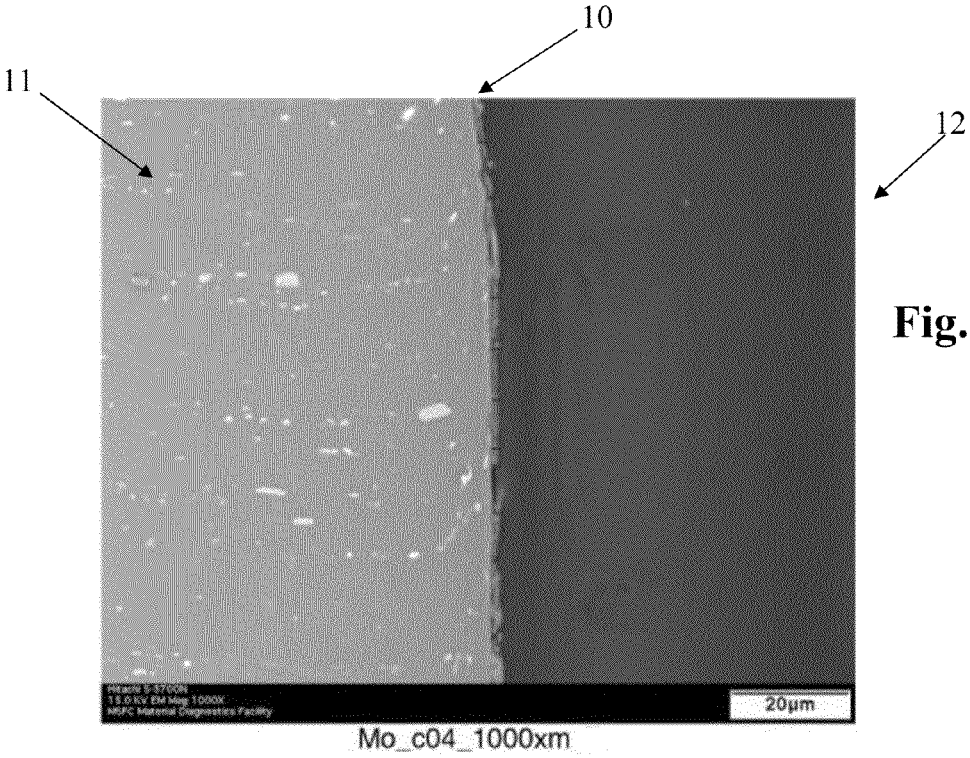
FIG. 11 shows the thickness of a molybdenum coating on aluminum from scanning electron microscope images.

Examples of Thickness Measurements of Metal Coatings Applied to an Aluminum Surface An ammonium molybdate Parent Solution A and a boric acid Parent Solution B were prepared as described above. Coatings of each solution were applied to an aluminum surface and the coatings were allowed to dry. The thickness of the aluminum coatings were measured using known scanning electron microscope techniques at the NASA Marshall Flight Center. The thickness of the coatings were calculated from the scanning electron microscope images. The images are shown in FIG. 10 for the boron coating and in FIG. 11 for molybdenum coating. The coating 10 is shown on the surface of the aluminum metal 11, against background 12. Several measurements were made along the length of the coating 10. The mean thickness±standard error for the coatings were 1.32+0.11 microns (n=7) for molybdenum and 1.22+0.25 microns for Boron (n=4).

Examples of Nitrogen Deposits

Figure 12:
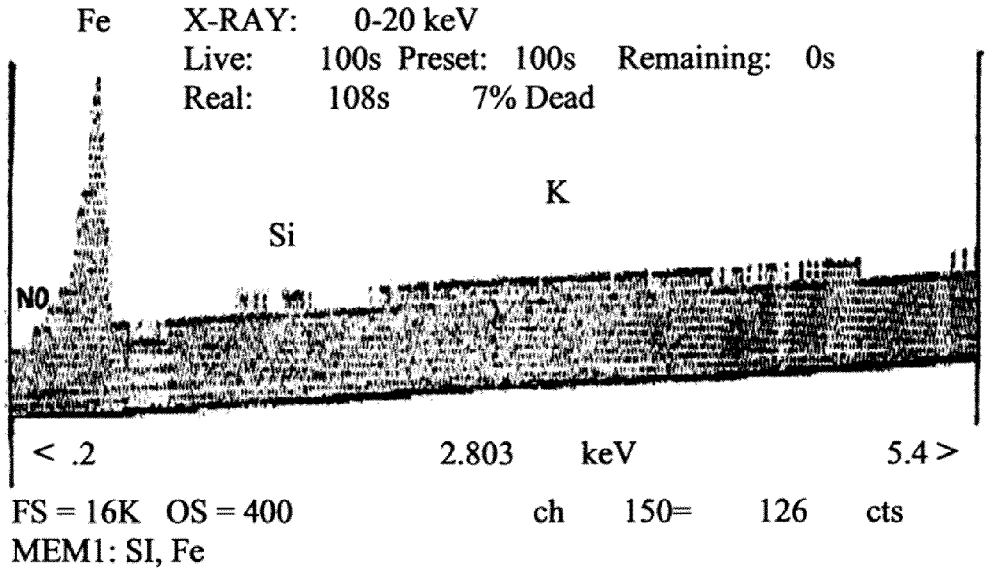
FIG. 12 shows the presence of nitrogen-silicon-potassium on 1010 carbon steel in EDAX chart I.
Figure 13:
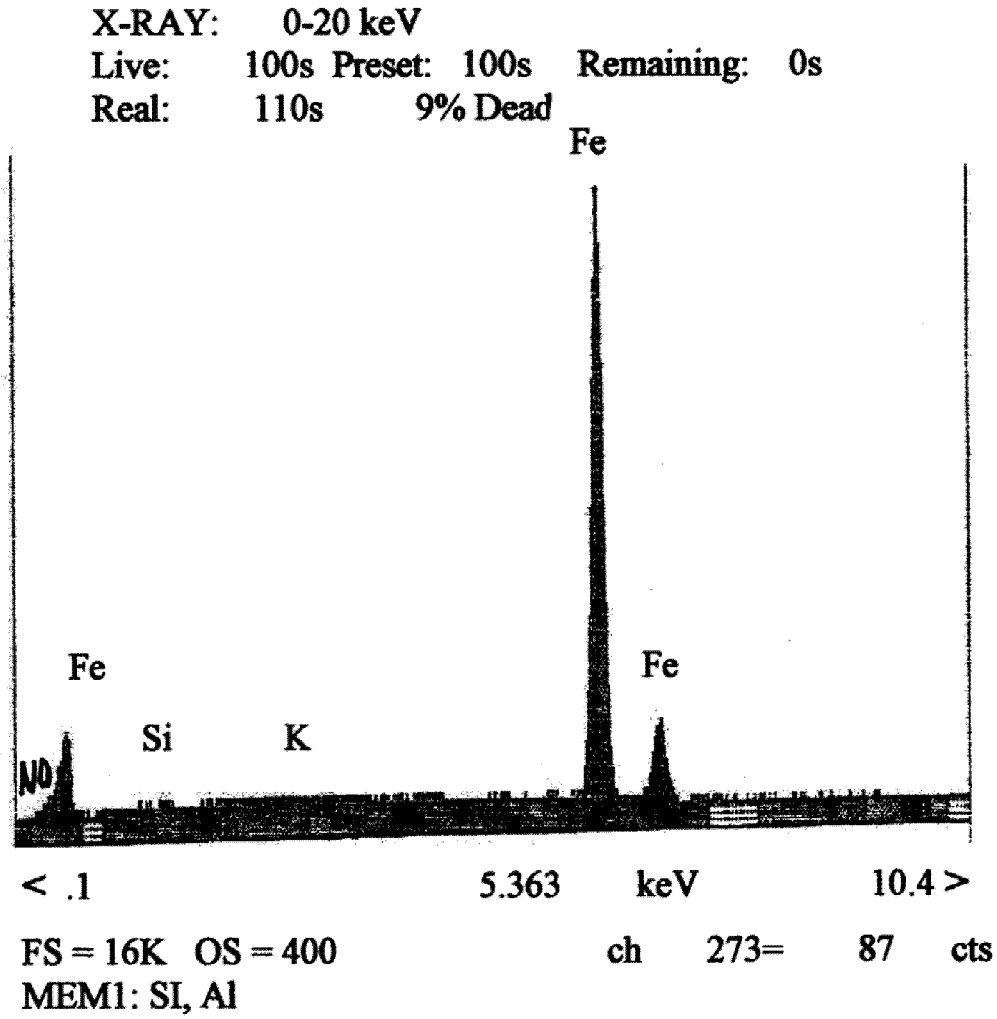
FIG. 13 Shows the presence of nitrogen-silicon-potassium on aluminum in EDAX chart II.
Figure 14:
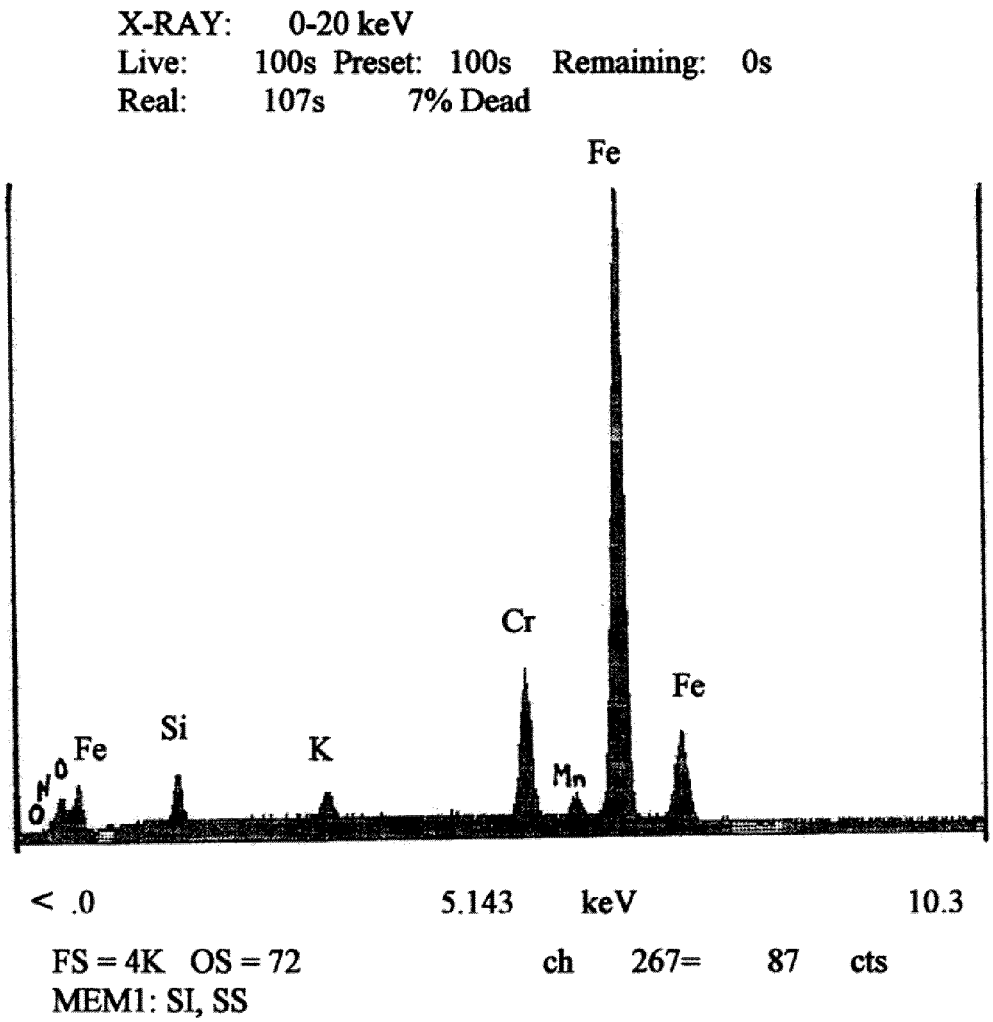
FIG. 14. Shows the presence of nitrogen-silicon-potassium on stainless steel in EDAX chart III.

Under current technology, nitrogen can only be deposited onto a metallic substrate by CVD (chemical vapor deposition), an expensive and very limited method of forming nitride surfaces. The method of the present invention also deposits nitrogen onto the metal substrate along with the metal being deposited. The analytical capabilities of SEM are limited to identifying elements of oxygen and above in the periodic table of the elements. Oxygen has an atomic weight of 8 and nitrogen has an atomic weight of 7. EDAX (electron dispersive analytical x-ray) can identify elements down to 6 in the period table. Aqueous solutions of silicon were prepared according to parent sample A described above. Coatings were applied to various metals and samples were run on EDAX at Corrmet Laboratories in Houston, Tex. with results as follows: FIG. 12 shows the presence of nitrogen-silicon-potassium on 1010 carbon steel in EDAX chart I. FIG. 13 shows the presence of nitrogen-silicon-potassium on aluminum in EDAX chart II. FIG. 14 shows the presence of nitrogen-silicon-potassium on stainless steel in EDAX chart III. These analytical results show that an entirely new technology for nitrogen/metallic surfaces on substrates can be available using the compositions and methods of the present invention. The deposition of nitrogen on metal also occurs when sulfuric acid is used instead of orthophosphoric acid in the reaction solutions.

Wear Tests

Wear testing was run on a dry film coating of the present invention, in comparison with a standard oil-based lubricant at Engineered Lubricants, Maryland Heights, Mo. On an Epsilon Linear Precision Test Machine, Tribology Testing Equipment. The machine is used to evaluate wear and extreme pressure properties of fluids and greases. The machine has the ability to evaluate the rate of wear throughout the test duration and compare wear in real time to all other indicated variables such as torque, friction, coefficient of friction, load specimen, RPM, specimen temperature, fluid temperature, specimen cycles, and test duration. Stainless steel pins and V Bars were used with the pins rotating against the V Bars under conditions up to 4,000 psi. The heat generated in the oil during the test is drawn off continuously. A stainless steel pin and V block were run in standard lubricating oil for 50 minutes. Wear was continuously recorded. A 1A stainless steel pin V block were immersed in the aqueous silicon/phosphate solution of the present invention for one minute, extracted and mailed to the testing laboratory. The wear test was run with the pre-coated pin and block for 50 minutes. The test results showed that wear using the oil-based lubricant and the dry film of the present invention were identical with 0.06 of an inch wear pattern. Thus, the dry film of silicon/phosphorous of the present invention has the same wear pattern as that observed using a standard lubricant.

The foregoing description has been limited to specific embodiments of this invention. It will be apparent, however, that variations and modifications may be made by those skilled in the art to the disclosed embodiments of the invention, with the attainment of some of all of its advantages and without departing from the spirit and scope of the present invention. For example, The present invention is not limited to the metals listed above, but is inclusive of all metals, including refractory metals. The solutions do not require the use of a peroxidic compound, a rare earth or an accelerator additive. The pH can be acidic, or neutral or alkaline depending upon which pH is the best solution for deposition of the ions for conversion surfaces. Further, the solution can be applied at ambient temperature without the pre-treatment and pre-cleaning steps required in the Hardin process. The solution can be applied to standing objects such as bridges, overpasses and other metallic structures in situ. These methods of application for forming conversion surfaces greatly decrease costs and allow for passivation of metal structures already built. Other metal surface techniques include pinging, glass beading, galvanizing.

It will be understood that various changes in the details, materials, and arrangements of the parts which have been described and illustrated above in order to explain the nature of this invention may be made by those skilled in the art without departing from the principle and scope of the invention as recited in the following claims.

The invention claimed is:

1. A process for producing aqueous solutions of non-alkaline metals for deposition of non-alkaline metals onto surfaces, comprising the steps:

1) forming a solution of water with orthophosphoric acid;
2) adding ammonium hydroxide to the solution of step 1, wherein the ammonium hydroxide is added over a period of at least 7 minutes to prevent a rapid or quick addition of the ammonium hydroxide to the solution of step 1, thereby preventing a highly or violent exothermic reaction;
3) adding an alkali metal hydroxide in water to the solution produced by steps 1 and 2; and
4) adding a non-alkaline metal salt to the solution produced by steps 1, 2 and 3, wherein the aqueous solution of step 4 produces a tenacious film on substrates by immersion, brushing, or spraying without the use of applied external electromotive force, said film containing said non-alkaline metal, phosphorous, and nitrogen, and said film forming an oxide-free conversion surface.

2. The process of claim 1, wherein step 1 further comprises forming a solution of 0.5 to 1.5 parts of water by volume with 0.5 to 1.5 parts of orthophosphoric acid by volume, wherein said orthophosphoric acid is 75% to 85%; step 2 further comprises adding 0.5 to 1.5 parts of ammonium hydroxide by volume to the solution of step 1 by volume, wherein said ammonium hydroxide is 20 to 30%; step 3 further comprises adding 0.5 to 1.5 parts of an alkali metal hydroxide in water by volume to the solution produced by steps 1 and 2 by volume, wherein said alkali metal hydroxide in water is 40% to 60%; and step 4 further comprises adding 0.1 to 10 grams of a non-alkaline metal salt to each 80 to 120 ml of the solution produced by steps 1, 2 and 3.

3. The process of claim 2 wherein said non-alkaline metal salt is a salt of copper, silver, gold, beryllium, magnesium, zinc, cadmium, aluminum, gallium, indium, silicon, tin, lead, titanium, zirconium, hafnium, antimony, bismuth, vanadium, niobium, tantalum, selenium, tellurium, chromium, molybdenum, tungsten, manganese, iron, cobalt, nickel, palladium, or rhodium, or a combination thereof, and wherein said alkali metal hydroxide is sodium hydroxide, potassium hydroxide, or lithium hydroxide, or a combination thereof.

4. A process for producing aqueous solutions of non-alkaline metals for deposition of non-alkaline metals onto surfaces, comprising the steps:

1) forming a solution of water with sulfuric acid;
2) adding ammonium hydroxide to the solution of step 1, wherein the ammonium hydroxide is added over a period of at least 7 minutes to prevent a rapid or quick addition of the ammonium hydroxide to the solution of step 1, thereby preventing a highly or violent exothermic reaction;
3) adding an alkali metal hydroxide in water to the solution produced by steps 1 and 2; and
4) adding a non-alkaline metal salt to the solution produced by steps 1, 2 and 3, wherein the aqueous solution of step 4 produces a tenacious film on substrates by immersion, brushing, or spraying without the use of applied external electromotive force, said film containing said non-alkaline metal, sulfur, and nitrogen, and said film forming an oxide-free conversion surface.

5. The process of claim 4, wherein step 1 further comprises forming a solution of 0.5 to 1.5 parts of water by volume with 0.5 to 1.5 parts of sulfuric acid by volume, wherein said sulfuric acid is 75% to 85%; step 2 further comprises adding 0.5 to 1.5 parts of ammonium hydroxide by volume to the solution of step 1 by volume, wherein said ammonium hydroxide is 20 to 30%; step 3 further comprises adding 0.5 to 1.5 parts of an alkali metal hydroxide in water by volume to the solution produced by steps 1 and 2 by volume, wherein said alkali metal hydroxide in water is 40% to 60%; and step 4 further comprises adding 0.1 to 10 grams of a non-alkaline metal salt to each 80 to 120 ml of the solution produced by steps 1, 2 and 3.

6. The process of claim 5 wherein said non-alkaline metal salt is a salt of copper, silver, gold, beryllium, magnesium, zinc, cadmium, aluminum, gallium, indium, silicon, tin, lead, titanium, zirconium, hafnium, antimony, bismuth, vanadium, niobium, tantalum, selenium, tellurium, chromium, molybdenum, tungsten, manganese, iron, cobalt, nickel, palladium, or rhodium, or a combination thereof, and wherein said alkali metal hydroxide is sodium hydroxide, potassium hydroxide, or lithium hydroxide, or a combination thereof.

7. A tenacious film on a surface comprising a non-alkaline metal salt, phosphorous, and nitrogen produced by:

1) forming a solution of water with orthophosphoric acid;
2) adding ammonium hydroxide to the solution of step 1, wherein the ammonium hydroxide is added over a period of at least 7 minutes to prevent a rapid or quick addition of the ammonium hydroxide to the solution of step 1, thereby preventing a highly or violent exothermic reaction;
3) adding an alkali metal hydroxide in water to the solution produced by steps 1 and 2;
4) adding a non-alkaline metal salt to the solution produced by steps 1, 2 and 3;
5) applying the solution of step 4 to said surface by immersion, brushing, or spraying without the use of applied external electromotive force; and
6) forming said tenacious film on said surface, said tenacious film having said non-alkaline metal salt, phosphorous, and nitrogen contained therein, wherein said tenacious film forms an oxide-free conversion surface.

8. The process of claim 7, wherein step 1 further comprises forming a solution of 0.5 to 1.5 parts of water by volume with 0.5 to 1.5 parts of orthophosphoric acid by volume, wherein said orthophosphoric acid is 75% to 85%; step 2 further comprises adding 0.5 to 1.5 parts of ammonium hydroxide by volume to the solution of step 1 by volume, wherein said ammonium hydroxide is 20 to 30%; step 3 further comprises adding 0.5 to 1.5 parts of an alkali metal hydroxide in water by volume to the solution produced by steps 1 and 2 by volume, wherein said alkali metal hydroxide in water is 40% to 60%; and step 4 further comprises adding 0.1 to 10 grams of a non-alkaline metal salt to each 80 to 120 ml of the solution produced by steps 1, 2 and 3.

9. The aqueous composition of claim 8 wherein said non-alkaline metal salt is a salt of copper, silver, gold, beryllium, magnesium, zinc, cadmium, aluminum, gallium, indium, silicon, tin, lead, titanium, zirconium, hathium, antimony, bismuth, vanadium, niobium, tantalum, selenium, tellurium, chromium, molybdenum, tungsten, manganese, iron, cobalt, nickel, palladium, or rhodium, or a combination thereof, and wherein said alkali metal hydroxide is sodium hydroxide, potassium hydroxide, or lithium hydroxide, or a combination thereof.

10. A tenacious film on a surface comprising a non-alkaline metal salt, sulfur, and nitrogen produced by:

1) forming a solution of water with sulfuric acid;
2) adding ammonium hydroxide to the solution of step 1, wherein the ammonium hydroxide is added over a period of at least 7 minutes to prevent a rapid or quick addition of the ammonium hydroxide to the solution of step 1, thereby preventing a highly or violent exothermic reaction;
3) adding an alkali metal hydroxide in water to the solution produced by steps 1 and 2;
4) adding a non-alkaline metal salt to the solution produced by steps 1, 2 and 3;
5) applying the solution of step 4 to said surface by immersion, brushing, or spraying without the use of applied external electromotive force; and
6) forming said tenacious film on said surface, said tenacious film having said non-alkaline metal salt, sulfur, and nitrogen contained therein, wherein said tenacious film forms an oxide-free conversion surface.

11. The process of claim 10, wherein step 1 further comprises forming a solution of 0.5 to 1.5 parts of water by volume with 0.5 to 1.5 parts of sulfuric acid by volume, wherein said sulfuric acid is 75% to 85%; step 2 further comprises adding 0.5 to 1.5 parts of ammonium hydroxide by volume to the solution of step 1 by volume, wherein said ammonium hydroxide is 20 to 30%; step 3 further comprises adding 0.5 to 1.5 parts of an alkali metal hydroxide in water by volume to the solution produced by steps 1 and 2 by volume, wherein said alkali metal hydroxide in water is 40% to 60%; and step 4 further comprises adding 0.1 to 10 grams of a non-alkaline metal salt to each 80 to 120 ml of the solution produced by steps 1, 2 and 3.

12. The aqueous composition of claim 11 wherein said non-alkaline metal salt is a salt of copper, silver, gold, beryllium, magnesium, zinc, cadmium, aluminum, gallium, indium, silicon, tin, lead, titanium, zirconium, hathium, antimony, bismuth, vanadium, niobium, tantalum, selenium, tellurium, chromium, molybdenum, tungsten, manganese, iron, cobalt, nickel, palladium, or rhodium, or a combination thereof, and wherein said alkali metal hydroxide is sodium hydroxide, potassium hydroxide, or lithium hydroxide, or a combination thereof.

13. A process for permanently depositing a non-alkaline metal on the surface of a recipient metal, comprising the steps of:

1) forming an aqueous solution by a process comprising:
   a) forming a solution of water with orthophosphoric acid;
   b) adding ammonium hydroxide to the solution of step a, wherein the ammonium hydroxide is added over a period of t at least 7 minutes to prevent a rapid or quick addition of the ammonium hydroxide to the solution of step a, thereby preventing a highly or violent exothermic reaction;
   c) adding an alkali metal hydroxide in water to the solution produced by steps a and b; and
   d) adding a non-alkaline metal salt to the solution produced by steps a, b and c;
2) applying said aqueous solution to the said surface of said recipient metal by immersion, brushing, or spraying without the use of applied external electromotive force; and
3) depositing a permanent metal coating of said non-alkaline metal, in combination with phosphorous and nitrogen, on the surface of said recipient metal wherein said metal coating forms an oxide-free conversion surface.

14. The process of claim 13, wherein step a further comprises forming a solution of 0.5 to 1.5 parts of water by volume with 0.5 to 1.5 parts of orthophosphoric acid by volume, wherein said orthophosphoric acid is 75% to 85%; step b further comprises adding 0.5 to 1.5 parts of ammonium hydroxide by volume to the solution of step a by volume, wherein said ammonium hydroxide is 20 to 30%; step c further comprises adding 0.5 to 1.5 parts of an alkali metal hydroxide in water by volume to the solution produced by steps a and b by volume, wherein said alkali metal hydroxide in water is 40% to 60%; and step d further comprises adding 0.1 to 10 grams of a non-alkaline metal salt to each 80 to 120 ml of the solution produced by steps a, b and c.

15. The process of claim 14 wherein said non-alkaline metal salt is a salt of copper, silver, gold, beryllium, magnesium, zinc, cadmium, aluminum, gallium, indium, silicon, tin, lead, titanium, zirconium, hafnium, antimony, bismuth, vanadium, niobium, tantalum, selenium, tellurium, chromium, molybdenum, tungsten, manganese, iron, cobalt, nickel, palladium, or rhodium, or a combination thereof, and wherein said alkali metal hydroxide is sodium hydroxide, potassium hydroxide, or lithium hydroxide, or a combination thereof.

16. A process for permanently depositing a non-alkaline metal on the surface of a recipient metal, comprising the steps of:

1) forming an aqueous solution by a process comprising:
   a) forming a solution of water with sulfuric acid;
   b) adding ammonium hydroxide to the solution of step a, wherein the ammonium hydroxide is added over a period of at least 7 minutes to prevent a rapid or quick addition of the ammonium hydroxide to the solution of step a, thereby preventing a highly or violent exothermic reaction;
   c) adding an alkali metal hydroxide in water to the solution produced by steps a and b; and
   d) adding a non-alkaline metal salt to the solution produced by steps a, b and c;
2) applying said aqueous solution to said surface of said recipient metal by immersion, brushing, or spraying without the use of applied external electromotive force; and
3) depositing a permanent metal coating of said non-alkaline metal, in combination with phosphorous and nitrogen, on the surface of said recipient metal wherein said metal coating forms an oxide-free conversion surface.

17. The process of claim 16, wherein step a further comprises forming a solution of 0.5 to 1.5 parts of water by volume with 0.5 to 1.5 parts of sulfuric acid by volume, wherein said sulfuric acid is 75% to 85%; step b further comprises adding 0.5 to 1.5 parts of ammonium hydroxide by volume to the solution of step a by volume, wherein said ammonium hydroxide is 20% to 30%; step c further comprises adding 0.5 to 1.5 parts of an alkali metal hydroxide in water by volume to the solution produced by steps a and b by volume, wherein said alkali metal hydroxide in water is 40% to 60%; and step d further comprises adding 0.1 to 10 grams of a non-alkaline metal salt to each 80 to 120 ml of the solution produced by steps a, b and c.

18. The process of claim 17 wherein said non-alkaline metal salt is a salt of copper, silver, gold, beryllium, magnesium, zinc, cadmium, aluminum, gallium, indium, silicon, tin, lead, titanium, zirconium, hafnium, antimony, bismuth, vanadium, niobium, tantalum, selenium, tellurium, chromium, molybdenum, tungsten, manganese, iron, cobalt, nickel, palladium, or rhodium, or a combination thereof, and wherein said alkali metal hydroxide is sodium hydroxide, potassium hydroxide, or lithium hydroxide, or a combination thereof.

* * * * *